US008888234B2

(12) United States Patent
Hayashi et al.

(10) Patent No.: US 8,888,234 B2
(45) Date of Patent: Nov. 18, 2014

(54) FLUID EJECTING APPARATUS

(75) Inventors: Takato Hayashi, Minowa-machi (JP); Hisashi Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 513 days.

(21) Appl. No.: 12/914,735

(22) Filed: Oct. 28, 2010

(65) Prior Publication Data

US 2011/0102499 A1 May 5, 2011

(30) Foreign Application Priority Data

Oct. 30, 2009 (JP) ..... 2009-250327
Jan. 25, 2010 (JP) ..... 2010-012984

(51) Int. Cl.
*B41J 2/165* (2006.01)

(52) U.S. Cl.
CPC ..... *B41J 2/16585* (2013.01); *B41J 2/16547* (2013.01)
USPC ..... 347/31

(58) Field of Classification Search
None
See application file for complete search history.

(56) References Cited

U.S. PATENT DOCUMENTS

| | | | | |
|---|---|---|---|---|
| 5,557,307 | A * | 9/1996 | Paroff | 347/34 |
| 5,969,731 | A * | 10/1999 | Michael et al. | 347/33 |
| 7,491,271 | B2 * | 2/2009 | Nakamura | 118/302 |
| 7,562,961 | B2 | 7/2009 | Inoue | |
| 2002/0044168 | A1 * | 4/2002 | Hashi et al. | 347/32 |
| 2010/0118084 | A1 | 5/2010 | Seshimio | |
| 2010/0245466 | A1 * | 9/2010 | Inoue | 347/30 |

FOREIGN PATENT DOCUMENTS

JP 2005-119284 5/2005

* cited by examiner

*Primary Examiner* — Alejandro Valencia
(74) *Attorney, Agent, or Firm* — Workman Nydegger

(57) ABSTRACT

Provided is a fluid ejecting apparatus including: a linear absorbing member which is disposed so as to face two or more nozzle rows adjacent to each other in a direction intersecting an extension direction of the nozzle rows while extending from one end of the nozzle row in the extension direction and being reversed at the other end thereof and to be turned back in a manner of reciprocating at least once in the extension direction, and absorbs the fluid ejected from the nozzles; a first movement mechanism which moves the absorbing member in a direction intersecting the extension direction of the nozzle row; and a second movement mechanism which moves the absorbing member while turning back the absorbing member so as to reciprocate at least once in the extension direction of the nozzle row.

5 Claims, 13 Drawing Sheets

FIG. 12

| MOVEMENT DISTANCE | | 21E | | 21D | | 21C | | 21B | | 21A | REVERSE |
|---|---|---|---|---|---|---|---|---|---|---|---|
| TWO TIMES | FORWARD MOVEMENT PATH F1 | V1 | (V2) | V1 | (V2) | V1 | (V2) | V1 | (V2) | V1 | (V2) |
| | BACKWARD MOVEMENT PATH F2 | V2 | (V1) | V2 | (V1) | V2 | (V1) | V2 | (V1) | V2 | (V1) |
| FOUR TIMES | FORWARD MOVEMENT PATH F1 | V1 | (V4) | V3 | (V2) | V1 | (V4) | V3 | (V2) | V1 | (V4) |
| | BACKWARD MOVEMENT PATH F2 | V2 | (V3) | V4 | (V1) | V2 | (V3) | V4 | (V1) | V2 | (V3) |
| TEN TIMES | FORWARD MOVEMENT PATH F1 | V1 | (V10) | V9 | (V8) | V7 | (V6) | V5 | (V4) | V3 | (V2) |
| | BACKWARD MOVEMENT PATH F2 | V2 | (V3) | V4 | (V5) | V6 | (V7) | V8 | (V9) | V10 | (V1) |
| FIVE TIMES | FORWARD MOVEMENT PATH F1 | V1 | (V5) | V4 | (V3) | V2 | (V1) | V5 | (V4) | V3 | (V2) |
| | BACKWARD MOVEMENT PATH F2 | V2 | (V3) | V4 | (V5) | V1 | (V2) | V3 | (V4) | V5 | (V1) |

FLUID EJECTING APPARATUS

CROSS REFERENCES TO RELATED APPLICATIONS

The entire disclosure of Japanese Patent Application Nos. 2009-250327, filed Oct. 30, 2009, 2010-012984, filed Jan. 25, 2010, are expressly incorporated by reference herein.

BACKGROUND

1. Technical Field

The present invention relates to a fluid ejecting apparatus, and particularly, to a flushing process of a printing head.

2. Related Art

An ink jet printer (hereinafter, referred to as "a printer") is widely known as a fluid ejecting apparatus which ejects ink droplets onto a printing sheet (medium). In this kind of printer, since ink evaporates from a nozzle of a printing head, ink in the nozzle is thickened or solidified, dust is attached to the nozzle, and bubbles are mixed with the ink in the nozzle, which causes an erroneous printing process. Therefore, generally, in a printer, in addition to an ejection operation of ejecting ink to a printing sheet, a flushing process of compulsorily ejecting ink in the nozzle to the outside is performed.

In a scanning-type printer, the flushing process is performed by moving a printing head to an area other than a printing area. However, in a printer including a line head in which a printing head is fixed, the printing head cannot move during a flushing process. Therefore, for example, JP-A-2005-119284 proposes a method of ejecting ink toward absorbing members provided in a surface of a sheet transporting belt.

However, in the method disclosed in JP-A-2005-119284, since the plural absorbing members are arranged at the same interval on the sheet transporting belt in accordance with the size of the printing sheet, problems arise in that ink needs to be ejected in every gap between the printing sheets during the flushing process, and in that the size or transporting speed of the printing sheet is limited. In addition, when the flushing process is performed on a planar absorbing member, ink is scattered in the form of a mist due to a wind pressure caused by an operation of ejecting ink droplets, which may contaminate the printing sheet or the sheet transporting belt.

SUMMARY

An advantage of some aspects of the invention is that it provides a fluid ejecting apparatus capable of simply performing a cleaning (flushing) process within a short time.

In order to solve the above-described problem, some aspects of the invention provide the fluid ejecting apparatus as below.

A fluid ejecting apparatus of the invention includes: a fluid ejecting head which has nozzle rows constituted by plural nozzles and arranged in plural rows, and ejects a fluid from the nozzle rows; a linear absorbing member which is disposed so as to face two or more nozzle rows adjacent to each other in a direction intersecting an extension direction of the nozzle rows while extending from one end of the nozzle row in the extension direction and being reversed at the other end thereof and to be turned back in a manner of reciprocating at least once in the extension direction, and absorbs the fluid ejected from the nozzles; a first movement mechanism which moves the absorbing member in a direction intersecting the extension direction of the nozzle row; and a second movement mechanism which moves the absorbing member while turning back the absorbing member so as to reciprocate at least once in the extension direction of the nozzle row.

The second movement mechanism may include a supply portion which supplies the absorbing member, a reversing portion which is formed at a position turning back the absorbing member, and a winding portion which winds the absorbing member.

The supply portion may be formed as a supply rotation body which supplies the absorbing member, the winding portion may be formed as a winding rotation body which winds the absorbing member, and all the supply rotation body and the winding rotation body may be formed at one end side of the extension direction.

The fluid ejecting apparatus may further include a cleaning mechanism that cleans the absorbing member.

The absorbing member may absorb the fluid ejected from a first nozzle row while ensuring non-absorbing areas at a predetermined interval in a forward movement path where the absorbing member moves from one end side of the extension direction toward the other end side thereof. The non-absorbing areas may absorb the fluid ejected from a second nozzle row adjacent to the first nozzle row in the intersection direction in a backward movement path where the absorbing member moves from the other end side of the extension direction toward the one end side thereof via the reversing portion.

BRIEF DESCRIPTION OF THE DRAWINGS

The invention will be described with reference to the accompanying drawings, wherein like numbers reference like elements.

FIG. 12 is a schematic diagram illustrating a movement of an absorbing area.

DESCRIPTION OF EXEMPLARY EMBODIMENTS

Figure 1:
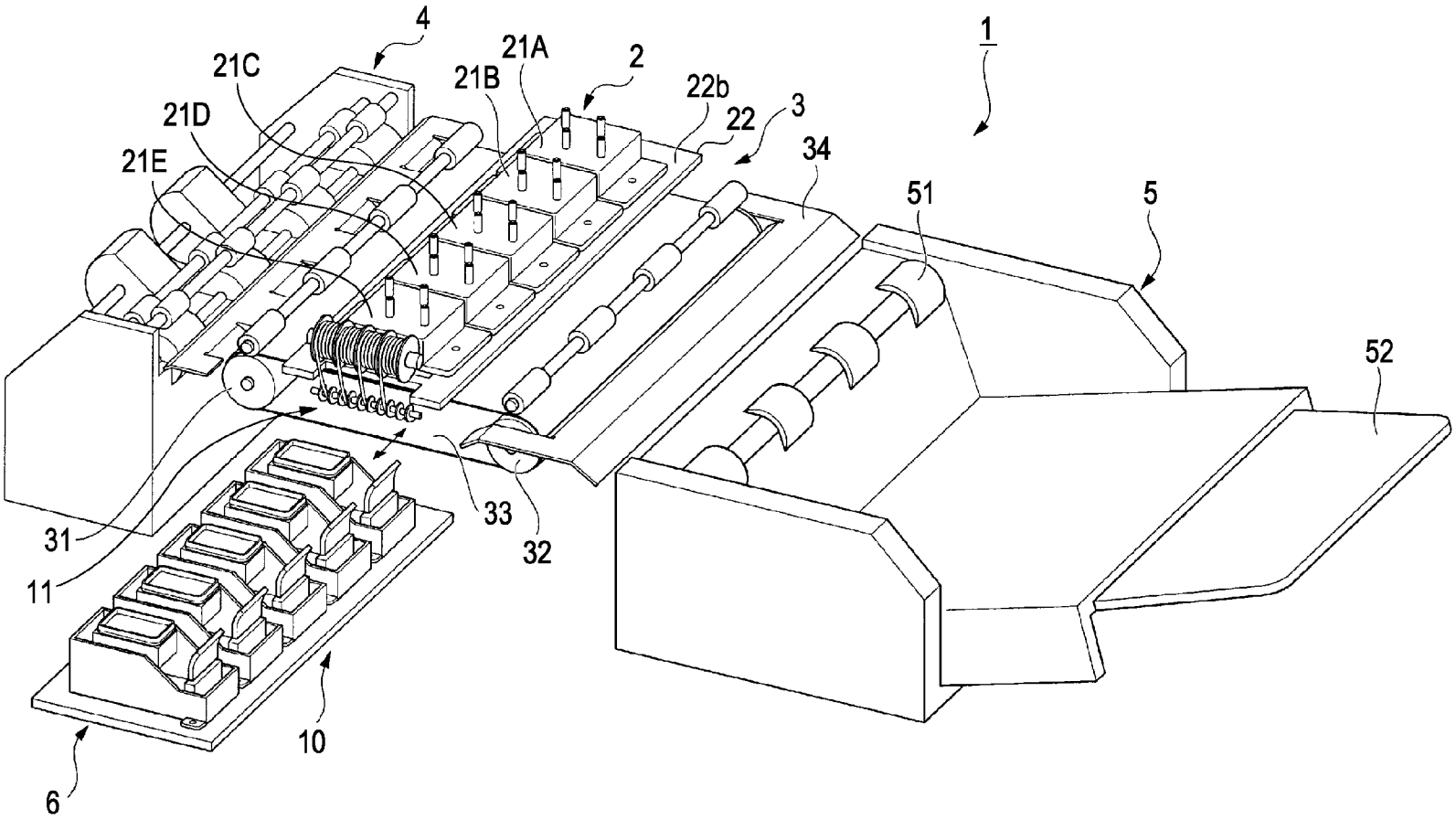
FIG. 1 is a perspective view illustrating a schematic configuration of a printer of a first embodiment.

Hereinafter, exemplary embodiments of a fluid ejecting apparatus according to the invention will be described with reference to the accompanying drawings. In addition, the embodiments are described in detail so that the concept of the invention can be understood more easily, and the invention is not limited thereto unless specifically stated. Further, in the drawings used for the description below, the main part is magnified for convenience of description and understanding the characteristics of the invention, and the scales of the respective components are not necessarily in practice equal to the actual scales.

First Embodiment

An embodiment of the fluid ejecting apparatus of the invention will be described. In the embodiment, an ink jet printer (hereinafter, simply referred to as a printer) will be described as an example of the fluid ejecting apparatus.

Printer

Figure 2:
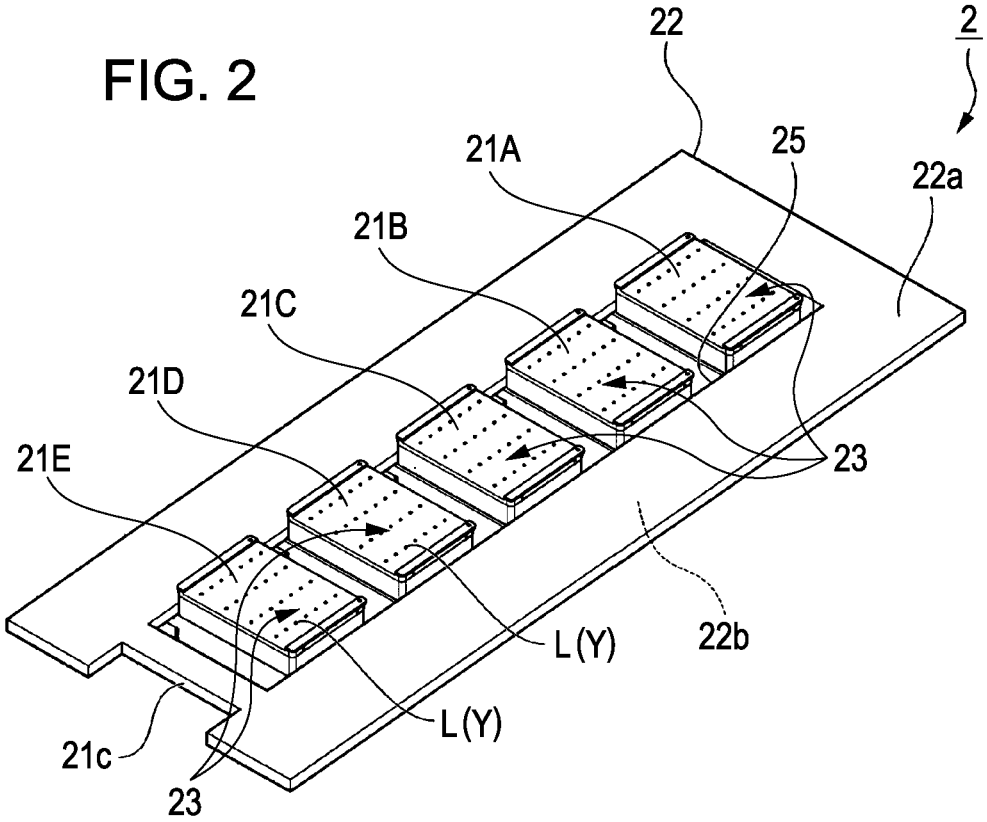
FIG. 2 is a perspective view illustrating a schematic configuration of a head unit of the first embodiment.
Figure 3:
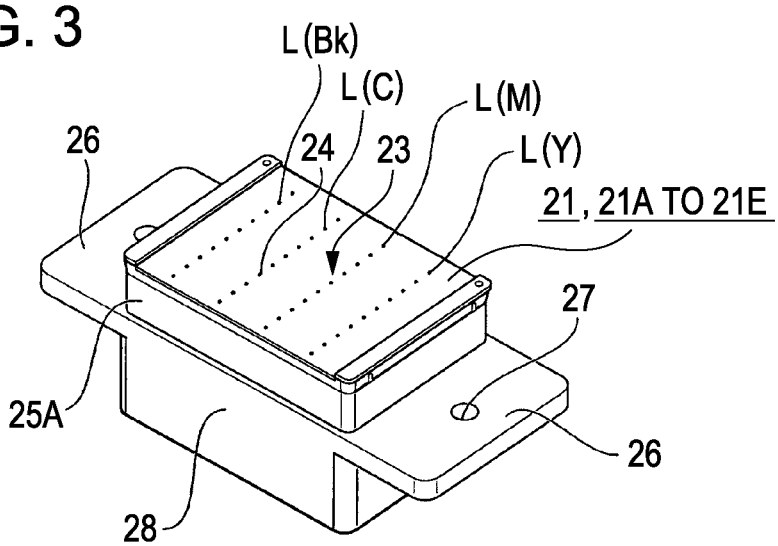
FIG. 3 is a perspective view illustrating a schematic configuration of a printing head of the first embodiment.
Figure 4:
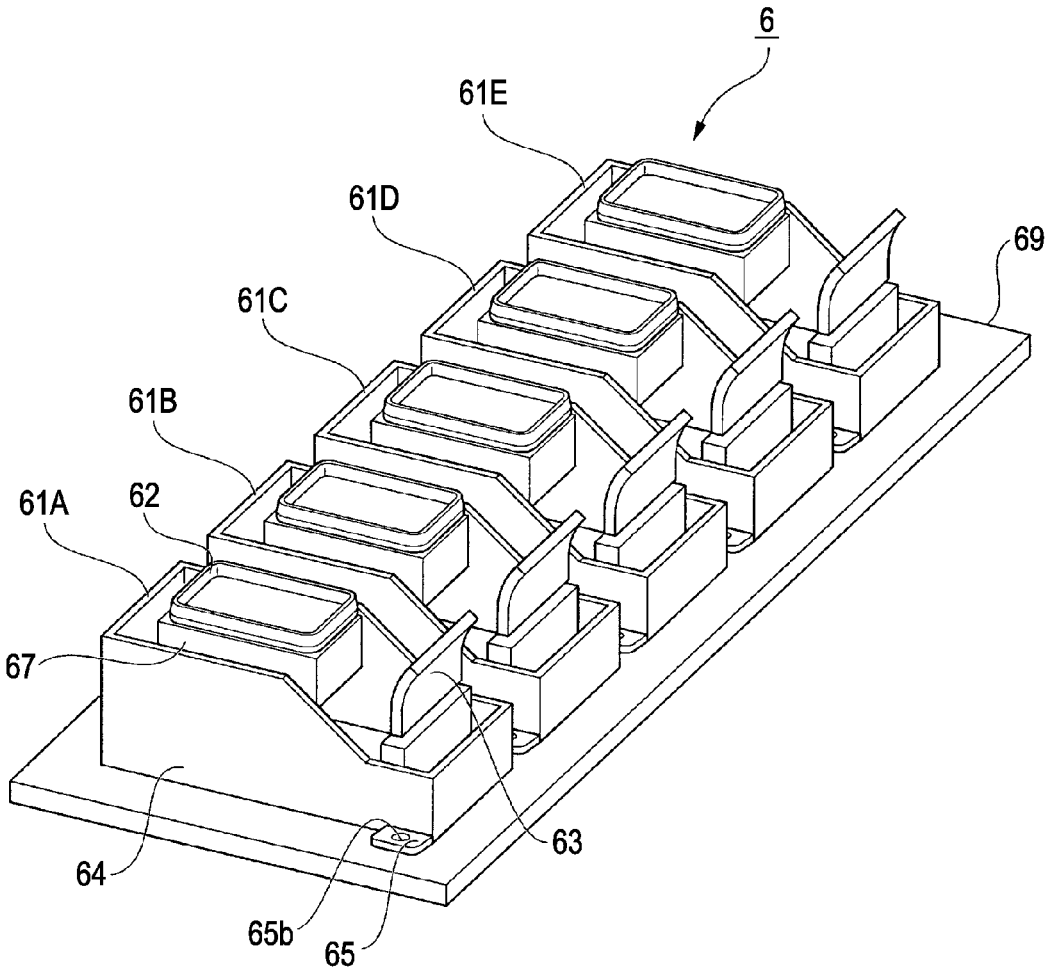
FIG. 4 is a perspective view illustrating a schematic configuration of a cap unit of the first embodiment.

FIG. 1 is a perspective view illustrating a schematic configuration of the printer. FIG. 2 is a perspective view illustrating a schematic configuration of a head unit. FIG. 3 is a perspective view illustrating a schematic configuration of a printing head constituting the head unit. FIG. 4 is a perspective view illustrating a schematic configuration of a cap unit.

As shown in FIG. 1, a printer 1 includes a head unit 2; a transportation device 3 which transports a printing sheet (medium); a sheet feeding unit 4 which supplies the printing sheet; a sheet discharging unit 5 which discharges the printing sheet printed by the head unit 2; and a maintenance device 10 which performs a maintenance process on the head unit 2.

The transportation device 3 is adapted to hold the printing sheet with a predetermined gap with respect to a nozzle surface 23 of each of printing heads 21 (21A, 21B, 21C, 21D, and 21E) constituting the head unit 2. The transportation device 3 includes a driving roller portion 31, a driven roller portion 32, and a transportation belt portion 33 that is constituted by a plurality of belts suspended between the roller portions 31 and 32. Further, a holding member 34 is provided between the sheet discharging unit 5 and the transportation device 3 so as to hold the printing sheet on the downstream side (the side of the sheet discharging unit 5) in the transportation direction of the printing sheet of the transportation device 3.

One end of the driving roller portion 31 in the rotation direction is connected to a driving motor (not shown), and is rotationally driven by the driving motor. The rotation force of the driving roller portion 31 is transmitted to the transporting belt portion 33, so that the transporting belt portion 33 is rotationally driven. If necessary, a transmission gear is provided between the driving roller portion 31 and the driving motor. The driven roller portion 32 is a so-called free roller which supports the transporting belt portion 33 and is rotated by the rotational driving operation of the transporting belt portion 33 (the driving roller portion 31).

The sheet discharging unit 5 includes a sheet discharging roller 51 and a sheet discharging tray 52 which holds the printing sheet transported by the sheet discharging roller 51.

The head unit 2 is formed as a unit that includes a plurality of (in the embodiment, five) printing heads 21A to 21E, and each nozzle 24 (refer to FIG. 3) of each of the printing heads 21A to 21E is adapted to eject plural colors of ink (for example, the ink of black B, magenta M, yellow Y, or cyan C). The printing heads 21A to 21E (hereinafter, referred to as the printing head 21) are attached to an attachment plate 22 to thereby form a unit. That is, the head unit 2 according to the embodiment forms a line head module in which the effective printing width of the head unit 2 is substantially equal to the transverse width (the width perpendicular to the transportation direction) of the printing sheet by a combination of the plurality of printing heads 21 (single head member). Further, the printing heads 21A to 21E have the same structure.

As shown in FIG. 2, the head unit 2 has a structure in which the printing heads 21A to 21E are arranged inside an opening 25 formed in the attachment plate 22. Specifically, since the printing heads 21A to 21E are screw-fixed to a rear surface 22*b* of the attachment plate 22, a nozzle surface 23 is disposed so as to protrude from a front surface 22*a* of the attachment plate 22 via the opening 25. In addition, the head unit 2 is mounted on the printer 1 in such a manner that the attachment plate 22 is fixed to a carriage (not shown).

The head unit 2 of the embodiment is adapted to be movable between a printing position and a maintenance position (in a direction depicted by the arrow in FIG. 1) by the carriage (not shown). Here, the printing position indicates a position facing the transportation device 3 and performing a printing process on the printing sheet. On the other hand, the maintenance position indicates a position retreating from the transportation device 3 and facing the maintenance device 10. At the maintenance position, the maintenance process (the suction process and the wiping process) is performed on the head unit 2.

As shown in FIG. 3, each of the printing heads 21A to 21E (hereinafter, simply referred to as the printing head 21) constituting the head unit 2 includes a head body 25A which includes the nozzle surface 23 having nozzle rows L constituted by the plurality of nozzles 24, and a support member 28 to which the head body 25A is attached.

Each of the printing heads 21A to 21E includes four nozzle rows (L(Y), L(M), L(C), and L(Bk)) respectively corresponding to four colors (yellow(Y), magenta(M), cyan(C), and black(Bk)). In each of the nozzle rows (L(Y), L(M), L(C), and L(Bk)), the nozzles 24 constituting the nozzle rows (L(Y), L(M), L(C), and L(Bk)) are arranged in the horizontal direction intersecting the transportation direction of the printing sheet, and more desirably are arranged in the horizontal direction perpendicular to the transportation direction of the printing sheet. Then, the extension direction of the printing heads 21A to 21E is aligned with the nozzle row L corresponding to the same color.

The support member 28 is provided with projection portions 26 and 26 that are formed on both sides in the length direction of the nozzle surface 23. In addition, each of the projection portions 26 and 26 is provided with a perforation hole 27 that is used to screw-fix the printing head 21 to the rear surface 22*b* of the attachment plate 22. Accordingly, the plurality of printing heads 21 is attached to the attachment plate 22, thereby forming the head unit 2 (refer to FIG. 1).

The maintenance device 10 includes a cap unit 6 which performs the suction process on the head unit 2 and a flushing unit 11 which receives the ink ejected by the flushing process.

As shown in FIG. 4, since the maintenance process is performed on the head unit 2, the cap unit 6 is formed as a unit that includes a plurality of (in the embodiment, five) cap portions 61A to 61E respectively corresponding to the printing heads 21A to 21E. The cap unit 6 is disposed at a position deviating from a printing area of the head unit 2, and is disposed herein at a position not facing the transportation device 3.

The cap portions 61A to 61E respectively correspond to the printing heads 21A to 21E, and to respectively come into contact with the nozzle surfaces 23 of the printing heads 21A to 21E. Since the cap portions 61A to 61E respectively come into close contact with the nozzle surfaces 23 of the printing heads 21A to 21E, it is possible to satisfactorily perform the suction process in which the ink (fluid) is discharged from the nozzle surfaces 23.

The cap portions 61A to 61E (hereinafter, simply referred to as the cap portion 61) constituting the cap unit 6 includes a cap body 67; a seal member 62 which is formed in a frame shape on the upper surface of the cap body 67 and comes into contact with the printing head 21; a wiper member 63 which is used for the wiping process in which the nozzle surface 23 of the printing head 21 is wiped; and a casing portion 64 which integrally holds the cap body 67 and the wiper member 63.

The bottom portion of the casing portion 64 is provided with two holding portions 65 (one of them is not shown) that holds the casing portion 64 using a base member 69. The holding portions 65 are disposed at positions forming an opposite angle in the casing portion 64 in a plan view. Each of the holding portions 65 is provided with a perforation hole 65*b* to which a screw is inserted so as to screw-fix the casing portion 64 to the base member 69.

Figure 5A:
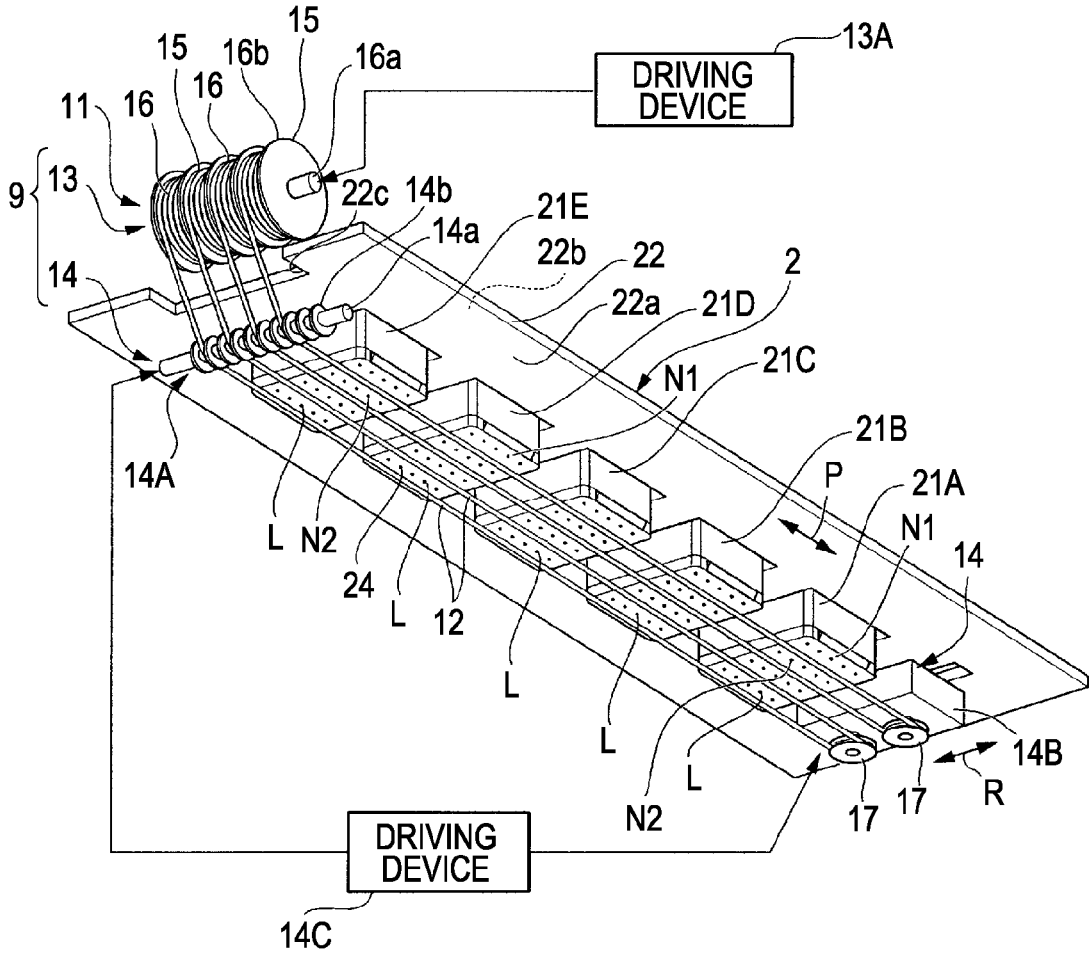
FIGS. 5A and 5B are perspective views illustrating a schematic configuration of a flushing unit of the first embodiment.
Figure 5B:
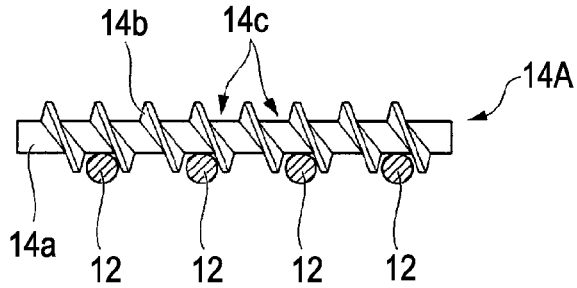

As shown in FIGS. 5A and 5B, the flushing unit 11 includes a plurality of absorbing members 12 which absorbs ink droplets ejected during the flushing process, and a support mechanism 9 which supports the plurality of absorbing members 12.

The absorbing member 12 is a linear member which absorbs the ink droplets ejected from each of the nozzles 24, and as shown in FIGS. 5A and 5B, two absorbing members are provided for each head unit 2. The absorbing members 12 respectively extend along the nozzle rows (L(Y), L(M), L(C), and L(Bk)) constituted by the nozzles 24 of the respective colors, and are disposed between the nozzle surfaces 23 and the transportation area of the printing sheet. Each of the absorbing members 12 is formed by, for example, a string.

An example of the absorbing member 12 includes a chemical fiber or the like having a surface subjected to a hydrophilic treatment, and it is desirable to effectively absorb and hold the ink. In addition, the absorbing member 12 has a width about 5 to 75 times larger than the diameter of the nozzle. In a general printer, a gap between each of the nozzle surfaces 23 of the printing heads 21A to 21E and the printing sheet is about 2 mm, and the diameter of the nozzle is about 0.02 mm. For this reason, when the absorbing member 12 has a diameter of 1 mm or less, the absorbing member 12 may be disposed between each nozzle surface and the printing sheet. Further, when the absorbing member 12 has a diameter of 0.2 mm or more, the ejected ink droplets may be absorbed by the absorbing member even when the component error is considered. For this reason, it is desirable that the absorbing member 12 is about 10 to 50 times larger than the diameter of the nozzle. Further, the absorbing member 12 will be described later in more detail.

Further, it is desirable that the length of the absorbing member 12 is sufficiently longer than the effective printing width of the head unit 2. Although it will be described in detail, the printer 1 of the embodiment adopts a configuration in which the used area (ink absorbing state) of the absorbing member 12 is sequentially wound, and the absorbing member 12 is exchanged when the entire area of the absorbing member 12 absorbs the ink. For this reason, it is desirable that the exchange period of the absorbing member 12 is set to a period that the absorbing member can be used practically, and the length of the absorbing member 12 is about several hundred times larger than the effective printing width of the head unit 2. However, when the absorbing member 12 is recycled by performing a cleaning process or the like in the printer 1, the length of the absorbing member 12 may be about twice as long as the effective printing width of the head unit 2. Then, the absorbing member 12 is supported by the support mechanism 9.

The support mechanism 9 includes a winding mechanism 13 (a second movement mechanism) and a movement mechanism 14 (a first movement mechanism). The support mechanism 9 is substantially integrated with the head unit 2.

The movement mechanism 14 is adapted to move the absorbing member 12 between the flushing position facing the nozzle 24 and the retreat position not facing the nozzle 24 by moving the absorbing member 12 in a direction R intersecting (in the embodiment, perpendicular to) an extension direction P of the nozzle row. Further, the winding mechanism 13 is adapted to move the absorbing member 12 in the extension direction by supplying or winding the absorbing member 12.

As shown in FIGS. 1 and 5A, the winding mechanism 13 includes a supply rotation body (supply portion) 15 and a winding rotation body (winding portion) 16 alternately arranged at one end side of the head unit 2 in the nozzle row direction P so as to be located on the side (the opposite side of the nozzle surfaces 23 of the heads 21A to 21E) of the rear surface 22*b* of the attachment plate 22 while the rotation shafts thereof are aligned with the transportation direction of the printing sheet. In addition, the winding mechanism 13 includes reversing portions (hereinafter, referred to as reversing rotation bodies) 17 which are arranged at the other end side of the head unit 2 in the nozzle row direction P on the side of the front surface 22*a* of the attachment plate 22 (the nozzle surfaces 23 of the heads 21A to 21E) while the rotation shafts thereof are perpendicular to the transportation direction of the printing sheet.

Each of the supply rotation body 15 and the winding rotation body 16 is formed in a bobbin shape that includes a rotation shaft 16*a* and a plurality of partition plates 16*b* arranged at the same interval in the rotation shaft 16*a*, where the supply rotation body 15 and the winding rotation body 16 are adapted to rotate in the opposite directions (the reverse directions). That is, the supply rotation body 15 rotates in a direction in which the absorbing member 12 is supplied toward the nozzle row, and the winding rotation body 16 rotates in a direction in which the absorbing member 12 passing the nozzle row is wound. Then, the reversing rotation body 17 turns back (reverses) the absorbing member 12, supplied from one end side of the head unit 2 toward the other end thereof, at the other end side of the head unit 2, and moves the absorbing member 12 toward one end side of the head unit 2 again.

The reversing rotation body 17 is adapted to reciprocate one absorbing member 12 while a certain first nozzle row N1 has a gap with respect to a second nozzle row N2 that is adjacent to the first nozzle row N1 in the direction R intersecting the nozzle row direction P. That is, in the flushing process, any one absorbing member 12 supplied from the supply rotation body 15 moves to a position overlapping with the first nozzle row N1 in the forward movement path that faces from one end side of the head unit 2 toward the other end side thereof in the nozzle row direction P. Then, the absorbing member 12 is turned back (reversed) by the reversing rotation body 17, moves to a position overlapping with the second nozzle row N2 in the backward movement path that faces from the other end side of the head unit 2 toward one end side thereof in the nozzle row direction P, and then is wound on the winding rotation body 16.

Subsequently, after the absorbing member 12 is completely wound, it is possible to easily exchange the absorbing member 12 with a replacement just by exchanging the supply rotation body 15 and the winding rotation body 16. Further, since both the supply rotation body 15 and the winding rotation body 16 are disposed at the same side, that is, one end side of the head unit 2 in the nozzle row direction P, it is possible to easily exchange the absorbing member 12 with a replacement just by opening one side surface of the printer 1, and thus to improve maintenance efficiency.

As shown in FIGS. 5A and 5B, the winding mechanism 13 includes a driving device 13A which rotationally drives the supply rotation body 15 and the winding rotation body 16 in the opposite directions. The driving device 13A is adapted to move the absorbing member 12 without any looseness by minutely adjusting the rotation amount thereof in accordance with a variation in the diameter caused by a variation in the winding amount of the absorbing member 12 of the supply rotation body 15 and the winding rotation body 16, that is, an increase or decrease in the winding amount of the absorbing member 12.

As shown in FIGS. 5A and 5B, the movement mechanism 14 includes a movement member 14A which has a projection portion 14*b* wound on a shaft portion 14*a* in a spiral shape, and a movement member 14B which minutely moves the reversing rotation bodies 17 in the direction R intersecting the nozzle row direction P at the rotation shafts thereof. The movement member 14A has a structure in which each of the absorbing members 12 is held by a guide groove 14*c* formed by the shaft portion 14*a* and the projection portion 14*b*.

The movement member 14A is disposed on the side of the front surface 22*a* of the attachment plate 22 (the nozzle surfaces 23 of the printing heads 21A to 21E) at the one end side of the head unit 2 in the nozzle row direction P. Further, the movement member 14B is disposed on the side of the front surface 22*a* of the attachment plate 22 (the nozzle surfaces 23 of the printing heads 21A to 21E) at the other end side of the head unit 2 in the nozzle row direction P. Then, the absorbing member 12 is suspended between the movement member 14A and the reversing rotation body 17. The end portion of the guide groove 14*c* in the vertical direction of the nozzle surface 23 has a positional relationship with respect to the nozzle surface 23 so that the end portion is located in a direction moving away from the nozzle surface 23. For this reason, the absorbing member 12 suspended between the movement member 14A and the reversing rotation body 17 can be held without coming into contact with the nozzle surfaces 23 of the printing heads 21A to 21E. That is, the movement members 14A and 14B serve as positioning members that uniformly maintain a distance between the absorbing member 12 and the nozzle surfaces 23 of the printing heads 21A to 21E.

Further, when the supply rotation body 15 and the winding rotation body 16 are directly disposed at the position of the movement member 14A without providing the movement members 14A and 14B, a positional deviation occurs between the absorbing member 12 and the nozzle surface 23 as the absorbing member 12 moves between the supply rotation body 15 and the winding rotation body 16. For this reason, this configuration is not desirable. That is, in the absorbing member 12 that is supplied from the supply rotation body 15 and is also wound on the winding rotation body 16, as the absorbing member 12 moves between the supply rotation body 15 and the winding rotation body 16, the supply position or the winding position thereof changes on the rotation body 15 (16) not only in the length direction of the shaft, but also in the direction (thickness direction) perpendicular to the shaft. Then, when the supply position or the winding position changes like this, consequently a positional deviation of the absorbing member 12 occurs in the horizontal direction or the vertical direction with respect to the nozzle surface 23.

Furthermore, as shown in FIGS. 5A and 5B, the movement mechanism 14 includes a driving device 14C which drives the movement members 14A and 14B. The absorbing member 12 moves to the flushing position and the retreat position when the movement member 14A rotates once. In addition, the movement member 14B minutely moves the reversing rotation body 17 in the direction R intersecting the nozzle row direction P while being interlocked with the movement amount of the absorbing member 12 caused by the rotation of the movement member 14A. This movement member 14B may be minutely moved by, for example, a rack-and-pinion or the like. Further, as the movement member 14A, a structure may be used in which the number of grooves formed in a shaft portion so as to circulate therearound is twice (two are required for the reciprocation movement of one absorbing member) or more the number of the absorbing members 12 instead of a structure in which the projection portion 14*b* is wound on the shaft portion in a spiral shape. In this case, as for the driving device 14C driving the movement member 14A, the driving device 14C may be adapted to minutely move the movement member 14A in the direction R intersecting the nozzle row direction P by the use of, for example, a rack-and-pinion or the like as in the manner of driving the movement member 14B.

The absorbing member 12 suspended between movement member 14A and the reversing rotation body 17 supported by the movement member 14B is wound and suspended on the supply rotation body 15 and the winding rotation body 16 while passing through a notch portion 22*c* provided in the attachment plate 22, and is prevented from coming into contact with the attachment plate 22. Accordingly, the movement of the absorbing member 12 becomes smooth.

Then, since the rotation speeds of the supply rotation body 15 and the winding rotation body 16 are respectively controlled by the driving device 13A, the support mechanism 9 holds the plurality of (two in FIGS. 5A and 5B) absorbing members 12, suspended and turned back between the movement member 14A and the reversing rotation body 17 supported by the movement member 14B, while applying an appropriate tension thereto so that the absorbing member is not bent. Accordingly, it is possible to prevent a problem that the absorbing member 12 is bent to come into contact with the nozzle surface 23 or the printing sheet (printing medium).

Figure 6A:
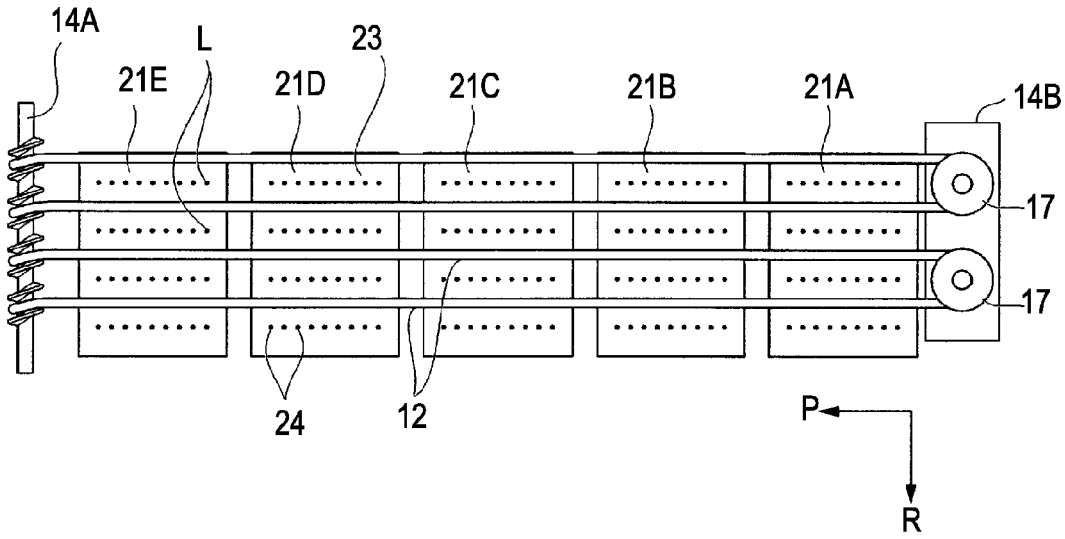
FIGS. 6A and 6B are plan views illustrating a movement position of an absorbing member of the first embodiment.
Figure 6B:
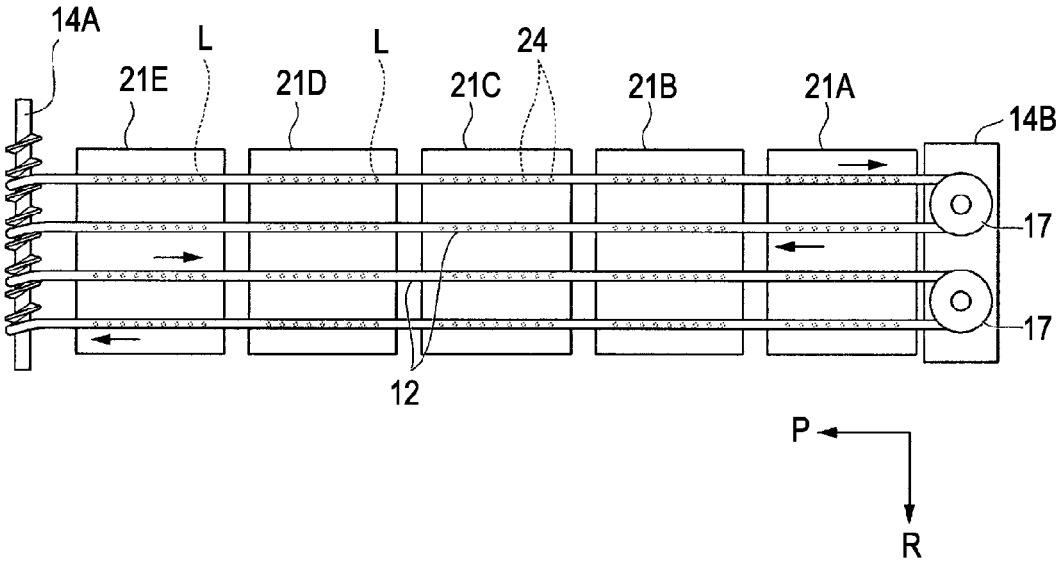

In this support mechanism 9, when the movement member 14A is rotated by the driving device 14C, the plurality of guide grooves 14*c* formed by the shaft portion 14*a* and the projection portion 14*b* moves along the axial direction in appearance. Further, the driving device 13B moves the reversing rotation body 17 along the direction R intersecting the nozzle row direction P while being interlocked with the movement amount in appearance. Accordingly, as shown in FIGS. 6A and 6B, it is possible to change the positions of the absorbing members 12 (the nozzle rows L) for the head unit 2. Specifically, it is possible to move the absorbing member 12 along the direction R intersecting the extension direction P of each nozzle row L of the head unit 2, that is, the transportation direction of the printing sheet.

In the embodiment, the absorbing member 12 moves between the flushing position and the retreat (printing) position. Here, when the diameter of the absorbing member 12 is set to 1 mm, the absorbing member 12 may be moved by 1 mm even when component dimension error or arrangement error is considered. When the gap of the projection portion 14*b* is set to 1 mm, since the absorbing member 12 moves by 1 mm in accordance with one rotation of the movement member, it is possible to easily and highly precisely move the plurality of absorbing members 12. Also, since the absorbing member 12 only moves by 1 mm, the time taken for the movement may be short. Further, since the distance between the printing head 21 and the printing sheet is 2 mm, and the absorbing member 12 is disposed therebetween while applying a tension to the absorbing member 12, the printing head 21 and the printing sheet may not move during the movement of the absorbing member.

Here, as shown in FIG. 6B, the flushing position indicates a position (a position on the flight path of the ink) where the ink droplets ejected from the nozzle rows L can be absorbed by the absorbing members during the flushing process when the absorbing members 12 respectively face (overlap with) the plurality of corresponding nozzle rows L (the plurality of nozzles 24 constituting the nozzle rows L). On the other hand, as shown in FIG. 6A, the retreat position of the absorbing member 12 indicates a position where the ink droplets used for printing and ejected from the nozzles 24 cannot be absorbed by the absorbing members 12 during the printing process when the absorbing members 12 do not respectively face (overlap with) the plurality of corresponding nozzle rows L (the plurality of nozzles 24 constituting the nozzle rows L). Further, herein, that the nozzle rows L respectively face the absorbing members 12 means not only that the center of the nozzle 24 overlaps with the center of the absorbing member 12 in a plan view, but also that the nozzle 24 is located within the width of the absorbing member 12 in a plan view. In this state, the ink ejected from the nozzle 24 can be absorbed by the absorbing member 12.

As shown in FIGS. 6A and 6B, when the movement members 14A and 14B are driven, all absorbing members 12 move. Then, each of the absorbing members 12 of the printer 1 of the embodiment is disposed between the printing sheet and the nozzle surface of the head 21 in the transportation direction of the printing sheet not only at the flushing position, but also at the retreat position.

Further, FIG. 1 shows only a pair of the head module 2, the maintenance device 10, and the flushing unit 12. However, in fact, a pair of the head module 2, the maintenance device 10, and the flushing unit 12 is already disposed in the transportation direction of the printing sheet. These two pairs have the same mechanical configuration, but are disposed to deviate from each other in the horizontal direction (the extension direction of the heads 21A to 21E) perpendicular to the transportation direction of the printing sheet. More specifically, when viewed in the transportation direction of the printing sheet, the heads 21A to 21E included in the head module 2 of the second pair are disposed between the heads 21A to 21E of the head module 2 of the first pair.

Like this, when two pairs of the head module 2, the maintenance device 10, and the flushing unit 12 are disposed to deviate from each other in the horizontal direction perpendicular to the transportation direction of the printing sheet, the heads 21A to 21E are disposed in zigzag on the whole. Accordingly, it is possible to eject the ink to the overall area of the effective printing width.

Here, in the two pairs of heads 21A to 21E arranged in zigzag in the two pairs of head modules 2, the pitch between the nozzles 24 constituting the nozzle rows L is formed to be uniform between the adjacent heads deviating from each other in the horizontal direction perpendicular to the transportation direction of the printing sheet. That is, the adjacent heads deviating from each other are arranged so that the pitch between the nozzles 24 and 24 located at the end portions on the inside of the heads is equal to the pitch between the adjacent nozzles 24 and 24 in the same head. However, in the adjacent heads deviating from each other, one or plural nozzles 24 located at the end portions on the inside of the heads may be arranged in one or plural rows along the transportation direction of the printing sheet between the heads. In such an arrangement, it is desirable that a fluid is not ejected from the nozzle 24 of one head among the nozzles 24 and 24 arranged in one or plural rows between the heads. With such a configuration, the pitch between the nozzles 24 in use becomes uniform.

Further, when the heads 21A to 21E are sequentially arranged in a direction perpendicular to the transportation direction of the printing sheet, only a pair of the head module 2, the maintenance device 10, and the flushing unit 12 may be used. In this case, since a sufficient gap is not formed between the heads 21A to 21E, it is difficult to respectively provide the cap portions 61A to 61E included in the maintenance device 10 for the heads 21A to 21E. For this reason, it is desirable to use a single cap portion that is capable of surrounding the nozzles 24 of all heads 21A to 21E.

Next, the detailed configuration of the absorbing member 12 suitably used in the printer 1 according to this embodiment will be described.

For example, the absorbing member 12 may be formed of fiber such as SUS 304, nylon, nylon applied with a hydrophobic coating, aramid, silk, cotton, polyester, ultrahigh molecular weight polyethylene, polyarylate, or Zylon (product name), or compound fiber containing a plurality of these.

In more detail, it is possible to form the absorbing member 12 in such a manner that plural fiber bundles formed of the fiber or the compound fiber are twisted or bound.

Figure 7A:
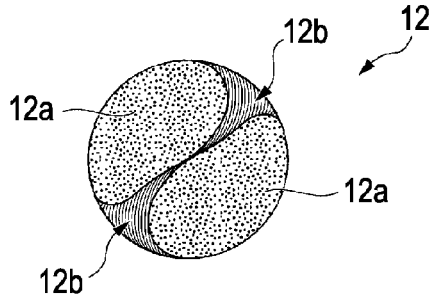
FIGS. 7A and 7B schematic diagrams illustrating the absorbing member included in the printer of the first embodiment.
Figure 7B:
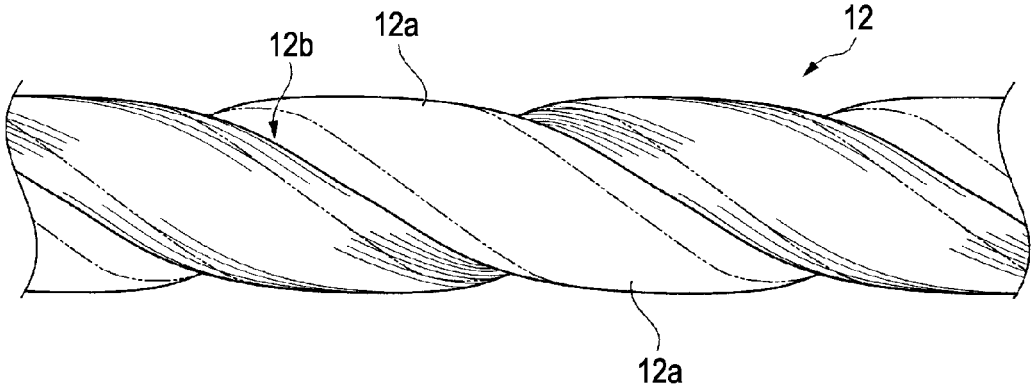

FIGS. 7A and 7B are schematic diagrams showing an example of the absorbing member 12, where FIG. 7A is a sectional view and FIG. 7B is a plan view. As shown in FIGS. 7A and 7B, for example, the absorbing member 12 is formed in such a manner that two (plural) fiber bundles (strings) 12*a* formed of fiber are twisted. As shown in FIGS. 7A and 7B, in the case where the absorbing member 12 is formed by twisting the plural fiber bundles 12*a*, since it is possible to store ink in a valley portion 12*b* formed between the fiber bundles 12*a*, it is possible to increase an ink absorption amount of the absorbing member 12.

In addition, as an example, a linear member obtained by twisting plural fiber bundles formed of SUS 304, a linear member obtained by twisting plural fiber bundles formed of nylon, a linear member obtained by twisting plural fiber bundles formed of nylon applied with hydrophobic coating, a linear member obtained by twisting plural fiber bundles formed of aramid, a linear member obtained by twisting plural fiber bundles formed of silk, a linear member obtained by twisting plural fiber bundles formed of cotton, a linear member obtained by twisting plural fiber bundles formed of Belima (product name), a linear member obtained by twisting plural fiber bundles formed of Soierion (product name), a linear member obtained by twisting plural fiber bundles formed of Hamilon 03 T (product name), a linear member obtained by twisting plural fiber bundles formed of Dyneema hamilon DB-8 (product name), a linear member obtained by twisting plural fiber bundles formed of Vectran hamilon VB-30, a linear member obtained by twisting plural fiber bundles formed of Hamilon S-5 Core Kevlar Sleeve Polyester (product name), a linear member obtained by twisting plural fiber bundles formed of Hamilon S-212 Core Coupler Sleeve Polyester (product name), a linear member obtained by twisting plural fiber bundles formed of Hamilon SZ-10 Core Zylon Sleeve Polyester (product name), or a linear member obtained by twisting plural fiber bundles formed of Hamilon VB-3 Vectran (product name) may be suitably used as the absorbing member 12.

Since the absorbing member 12 obtained by the fiber of nylon is formed of nylon widely used as a general leveling string, the absorbing member 12 is cheap.

Since the absorbing member 12 using the metallic fiber of SUS has an excellent corrosion resistance property, it is possible to allow the absorbing member 12 to absorb a variety of ink. Also, since the absorbing member 12 has an excellent wear resistance property compared with a resin, it is possible to repeatedly use the absorbing member 12.

The absorbing member 12 using the fiber of ultrahigh molecular weight polyethylene has high breaking strength and chemical resistance, and is strong against an organic solvent, acid, or alkali. Likewise, since the absorbing member 12 using the fiber of ultrahigh molecular weight polyethylene has high breaking strength, it is possible to pull the absorbing member 12 in a high-tension state, and to prevent the absorbing member 12 from being bent. For this reason, in the case where the diameter of the absorbing member 12 is thickened so as to increase the absorbing capacity or the diameter of the absorbing member 12 is not thickened, it is possible to improve the printing precision by narrowing the distance between the printing sheet transporting region and the head 21. In addition, it is expected that the above-described advantage is obtained even in the absorbing member 12 using the fiber of Zylon or an aramid and the absorbing member 12 using the fiber of super-high-molecular polyethylene.

The absorbing member 12 using the fiber of cotton has an excellent ink absorbing property.

In the absorbing member 12, the dropped ink is accommodated and absorbed in the valley portion 12*b* (see FIGS. 5A and 5B) formed between the fiber bundle 12*a* and the fiber due to the surface tension.

In addition, a part of the ink dropped onto the surface of the absorbing member 12 directly enters into the absorbing member 12, and the rest moves to the valley portion 12*b* formed between the fiber bundles 12*a*. Further, a part of the ink entering into the absorbing member 12 gradually moves in the extension direction of the absorbing member 12 in the inside of the absorbing member 12 so as to be held therein while being dispersed in the extension direction of the absorbing member 12. A part of the ink moving to the valley portion 12*b* of the absorbing member 12 gradually enters into the absorbing member 12 through the valley portion 12*b*, and the rest remains in the valley portion 12*b* so as to be held therein while being dispersed in the extension direction of the absorbing member 12. That is, a part of the ink dropped onto the surface of the absorbing member 12 stays at the dropped position, and the rest is dispersed and absorbed in the vicinity of the dropped position.

In addition, in fact, a material forming the absorbing member 12 provided in the printer 1 is selected in consideration of an ink absorbing property, an ink holding property, a tensile strength, an ink resistance property, formability (a generated amount of fluff or fraying), distortion, cost, or the like.

Further, the ink absorbing amount of the absorbing member 12 is the sum of the amount of ink held between the fibers of the absorbing member 12 and the amount of ink held in the valley portion 12*b*. For this reason, the material forming the absorbing member 12 is selected so that the ink absorbing amount is sufficiently larger than the amount of the ink ejected during the flushing process in consideration of the exchange frequency of the absorbing member 12.

Furthermore, the amount of ink held between the fibers of the absorbing member 12 and the amount of ink held in the valley portion 12*b* may be determined by the contact angle between the ink and the fibers, and the capillary force between the fibers depending on the surface tension of the ink. That is, when the absorbing member 12 is formed of thin fibers, the gap between the fibers increases and the surface area of the fiber increases. Accordingly, even when the sectional area of the absorbing member 12 is uniform, the absorbing member 12 is capable of absorbing a larger amount of ink. As a result, in order to obtain more gaps between the fibers, a micro fiber (ultrafine fiber) may be used as a fiber forming the fiber bundle 12*a*.

However, the ink holding force of the absorbing member 12 decreases since the capillary force decreases due to an increase in the gap between the fibers. For this reason, it is necessary to set the gap between the fibers so that the ink holding force of the absorbing member 12 is of a degree that the ink is not dropped due to the movement of the absorbing member 12.

In addition, the thickness of the absorbing member 12 is set so as to satisfy the above-described ink absorbing amount. In detail, for example, the thickness of the absorbing member 12 is set to be equal to or more than 0.3 mm and equal to or less than 1.0 mm, and more desirably about 0.5 mm.

However, in order to prevent the absorbing member 12 from coming into contact with the head 21 and the printing sheet, the thickness of the absorbing member 12 is set so that the maximum dimension of the section is equal to or less than a dimension obtained by subtracting an amount excluding the displacement amount caused by the bending of the absorbing member 12 from the distance of the sheet transporting region between the printing sheet and the head 21.

In addition, the cross-sectional shape of the absorbing member 12 may not be formed in a circular shape, but may be formed in a polygonal shape or the like. Here, since it is difficult to form the absorbing member in a perfect circular shape, the circular shape includes a substantially circular shape.

In the printer 1 with the above-described configuration, the ink is not ejected from all the nozzles 24 during a time when the printing process is performed by ejecting the ink from the heads 21A to 21E to the printing sheet. For this reason, the viscosity of the ink inside the nozzle 24 that does not eject the ink increases since the ink is dried. When the viscosity of the ink increases, a desired amount of the ink cannot be ejected from the nozzle. For this reason, the flushing process of ejecting the ink to the absorbing member 12 is periodically performed so that the viscosity of the ink does not increase.

Then, the absorbing member 12 included in the printer 1 of the embodiment is located at the retreat position deviating from a position below the nozzle 24 when performing the printing process on the printing sheet, and is located at the flushing position directly below the nozzle 24 when performing the flushing process. That is, since the absorbing member 12 is located directly below the nozzle 24 when performing the flushing process, the printing process cannot be performed, and needs to be stopped. For this reason, it is desirable to perform the flushing process when a gap between the transported printing sheets is located directly below the nozzle. In a so-called line head printer such as the printer 1 of the embodiment, since the printing process is generally performed on about 60 printing sheets per 1 minute, the gap between the printing sheets is located directly below the nozzle every 1 second.

Accordingly, in the printer 1 of the embodiment, the flushing process is performed, for example, every 5 or 10 seconds.

Further, when the printing process is continuously performed on the plurality of printing sheets, the time that the gap between the printing sheets is located directly below the nozzle 24 is short. In the existing printer, the movement of the head unit or the absorbing member used to perform the flushing process is large. For this reason, in the existing printer 1, the flushing process cannot be completed for the short time, and the transportation of the printing sheet is temporarily stopped. This period of stop time may decrease the number of printing sheets printed per unit hour. On the contrary, in the printer 1 of the embodiment, the printing process and the flushing process can be switched to each other just by moving the absorbing member 12 within the extremely narrow area directly below the heads 21A to 21E in a plan view. For this reason, it is possible to complete the flushing process during a time when the gap between the printing sheets is located directly below the nozzle 24, or to extremely shorten the period of time that the transportation of the printing sheet is stopped for the flushing process.

Next, the operation of the printer 1 of the embodiment involving the above-described flushing process will be described with reference to the flowchart shown in FIG. 8. FIGS. 9, 10A, 10B, and 11 are cross-sectional views illustrating an operation of a main part of the printer. In addition, the operation of the printer 1 of the embodiment is generally controlled by a control device (not shown).

The printer 1 starts the flushing process on the basis of a predetermined command.

Figure 8:
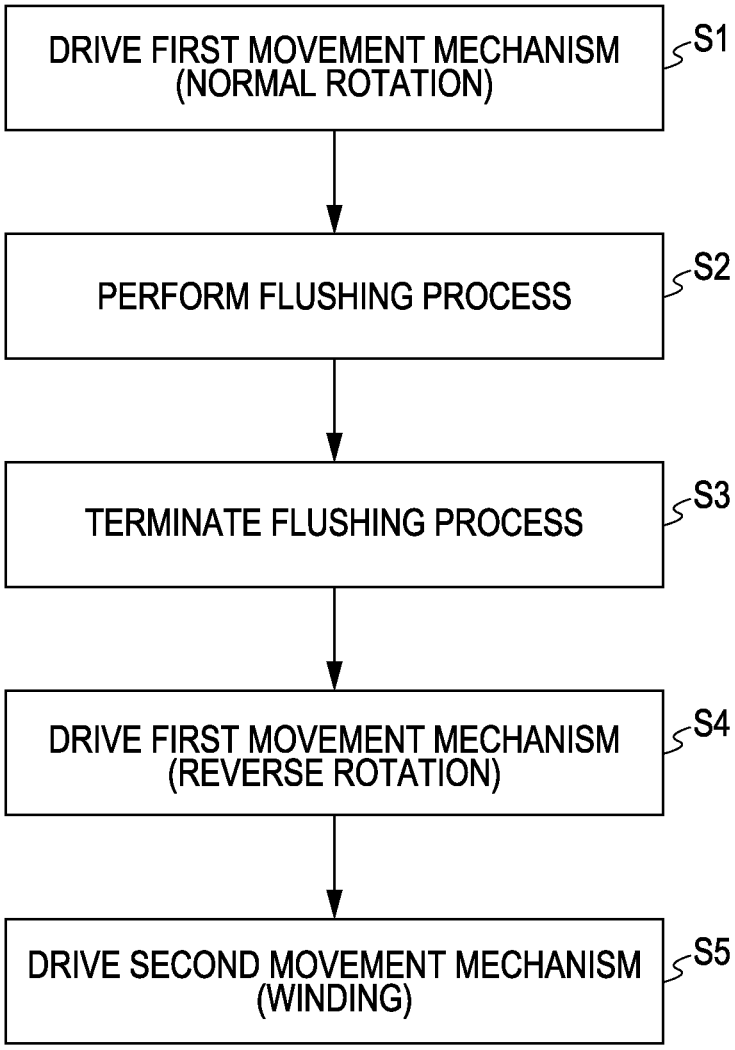
FIG. 8 is a flowchart illustrating an operation of the printer of the first embodiment.
Figure 9:
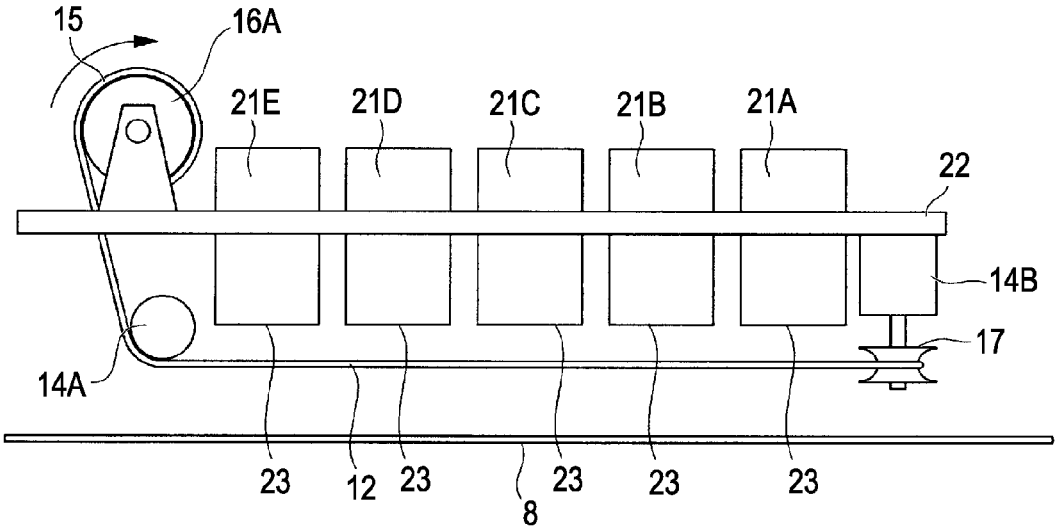
FIG. 9 is a cross-sectional view illustrating an operation of a main part of the printer of the first embodiment.

First, the control device drives the movement mechanism (the first movement mechanism) 14 shown in FIG. 9 (FIG. 8: S1), and moves the plurality of supported absorbing members 12 to the flushing position shown in FIG. 10A. Specifically, the control device rotates the movement member 14A by a predetermined number of rotations (in the embodiment, 1 rotation) in the normal direction, and moves the movement member 14B by a predetermined amount while being synchronized with the rotation so that the absorbing members 12 respectively face the nozzle rows L of the printing heads 21A to 21E. At this time, as shown in FIG. 9, the absorbing members 12 face the plurality of nozzle rows L arranged in the extension direction of the printing heads 21A to 21E.

In this way, two absorbing members 12 are made to overlap with the extension lines of the nozzle rows L in the ink ejecting direction.

Subsequently, the control device performs the flushing process on the head unit 2 (FIG. 8: S2), and ejects the ink droplets from the nozzle rows L (the nozzles 24) of the printing heads 21A to 21E to the opposite absorbing members 12 (for example, about 10 droplets). The ink droplets ejected from the nozzle rows L are absorbed by the absorbing member 12.

Figure 10A:
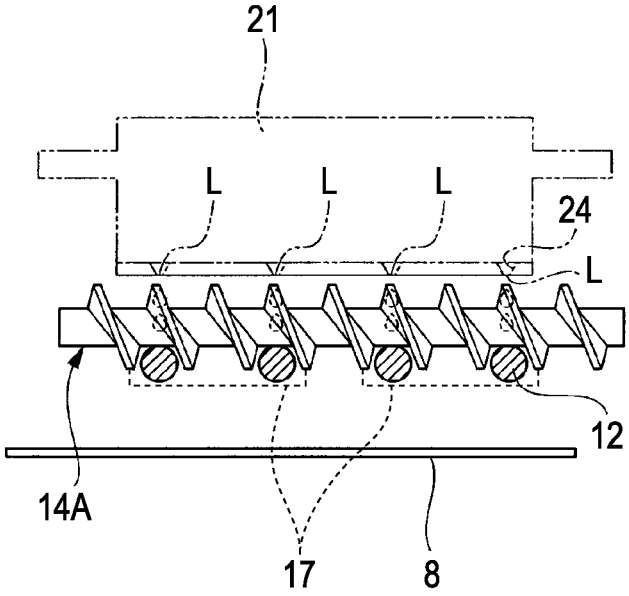
FIG. 10A is a diagram illustrating a flushing position of the absorbing member.
Figure 10B:
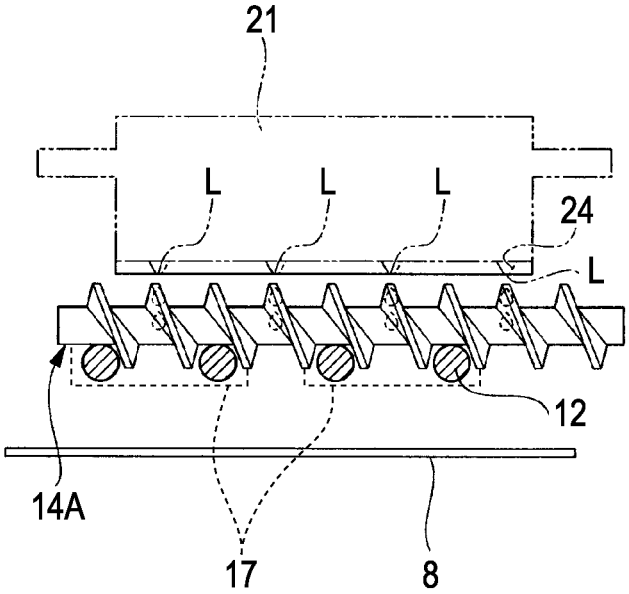
FIG. 10B is a diagram illustrating a retreat position of the absorbing member.

When the flushing process is terminated (FIG. 8: S3), the control device drives the movement mechanism (the first movement mechanism) 14, and moves the plurality of absorbing members 12 to the retreat position as shown in FIG. 10B (FIG. 8: S4).

Specifically, the control device rotates the movement member 14A by a predetermined number of rotations (in the embodiment, 1 rotation) in the reverse direction, and moves the movement member 14B while being synchronized with the rotation so that the absorbing members 12 facing the nozzle rows L retreat from the position facing the nozzle rows L.

Then, the control device drives the winding mechanism (the second movement mechanism) 13 to move the absorbing members 12 (FIG. 8: S5). The flushing process using the absorbing members 12 is performed between the printing sheets, but the movement of the absorbing members 12 using the movement mechanism 14 or the winding mechanism 13 is performed during a time when the printing process is performed on the printing sheet.

Figure 11:
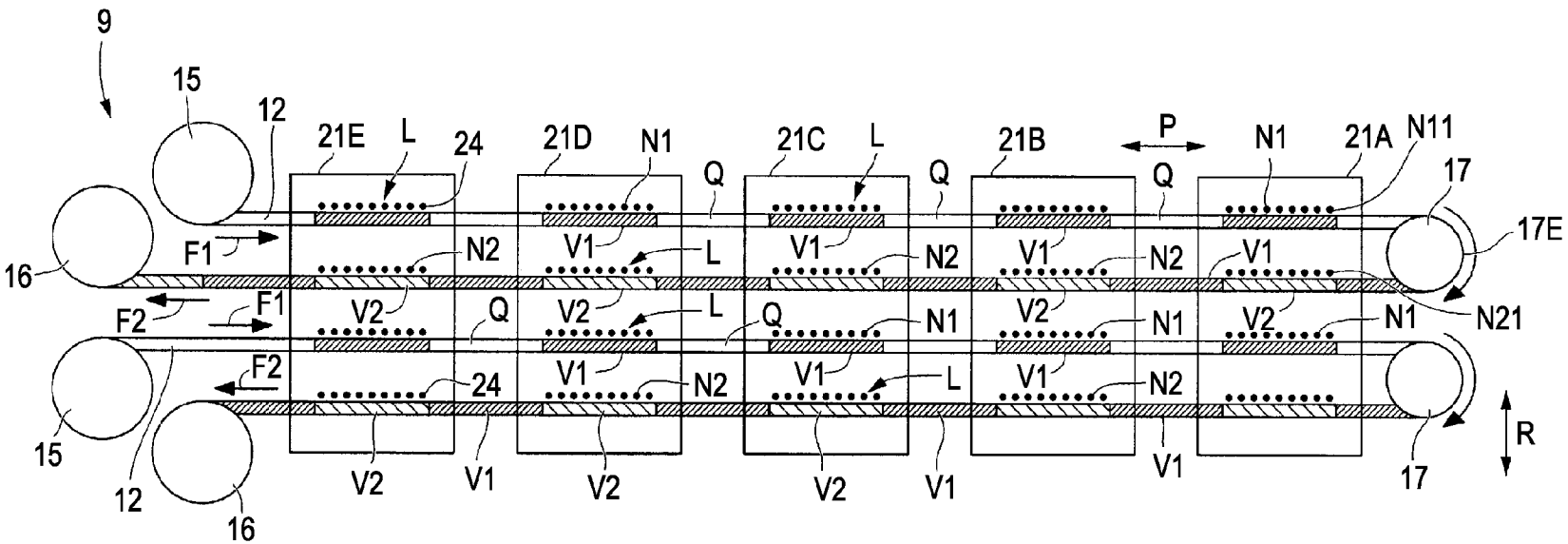
FIG. 11 is a plan view illustrating an operation of a main part of the printer of the first embodiment.

FIG. 11 is a plan view illustrating an operation of a main part of the printer during the flushing process. Further, in FIG. 11, the supply rotation body 15 and the winding rotation body 16 are actually arranged to overlap with each other in a direction perpendicular to the paper surface, but the positions thereof are intentionally depicted to deviate from each other for the description of the individual movement thereof. Furthermore, the absorbing members 12 are disposed to overlap with the nozzle rows L during the flushing process, but the positions thereof are intentionally depicted to deviate from each other and the movement mechanism 14 is not shown in the drawing for the description of the ejecting (absorbing) position thereof.

The absorbing member 12 is located at a position overlapping with the first nozzle row N1 which is, for example, an odd-number-nth row among the nozzle rows L of the printing heads 21A to 21E in the forward movement path F1 facing from one end side of the head unit 2 toward the other end side thereof in the nozzle row direction P. Then, in the forward movement path F1, the (flushing) fluid ejected from the first nozzle row N1 is absorbed. Accordingly, the absorbing member 12 has a first absorbing area V1 that absorbs the flushing fluid ejected from the first nozzle row N1. The first absorbing area V1 is substantially equal to the length of the first nozzle row N1. A non-absorbing area Q that does not absorb the fluid is formed between the first absorbing areas V1. Then, since the width (the length) of the non-absorbing area Q is equal to a gap between the adjacent nozzle rows L of the printing heads 21A to 21E, the width is equal to the length of the nozzle row N1.

In this way, in the forward movement path F1, the absorbing member 12 absorbing the flushing fluid ejected from the first nozzle row N1 is turned back by the reversing rotation body (the reversing portion) 17 while ensuring the non-absorbing area Q at a predetermined interval. Then, in the backward movement path F2 facing the other end side of the head unit 2 toward one end side thereof in the nozzle row direction P, the absorbing member 12 moves to a position overlapping with a second nozzle row N2 which is an even-number-nth row adjacent to the first nozzle row N1 among the nozzle rows L of the printing heads 21A to 21E. That is, one absorbing member 12 is turned back by the reversing rotation body 17 to move to a position overlapping with the second nozzle row N2 which is adjacent to the first nozzle row N1.

Here, a distance from the nozzle N11 located closest to the reversing rotation body 17 in the printing head 21A to the outermost end (a distance farthest from the head) 17E of the reversing rotation body 17 is equal to the length of the nozzle row L (N1). That is, strictly speaking, a distance in the path from a position closer to the reversing rotation body 17 than the center of the nozzle N11 by a half of the pitch between the nozzles to the outermost end (a position farthest from the head) 17E of the reversing rotation body 17 is set to be equal to the length of the nozzle row L (N1). Accordingly, a distance in the path from the nozzle N11 (strictly speaking, a position close to the reversing rotation body 17 by a half of the pitch between the nozzles) closest to the reversing rotation body 17 in the printing head 21A to the nozzle N21 (strictly speaking, a position close to the reversing rotation body 17 by a half of the pitch between the nozzles) located closest to the reversing rotation body 17 of the next nozzle row L (N2) while passing (being reversed) by the reversing rotation body 17 is set to be twice as long as the length of the nozzle rows L (N1 and N2). Then, the movement amount of the absorbing member 12 moved by the winding mechanism 13 is set to be twice as long as the length of the nozzle rows L (N1 and N2).

Then, the non-absorbing area Q of the absorbing member 12 turned back by the reversing rotation body 17 faces the second nozzle row N2 which is an even-number-nth row of each of the printing heads 21A to 21E in the backward movement path F2. Subsequently, the (flushing) fluid is ejected to the non-absorbing area Q. Accordingly, the absorbing member 12 has a second absorbing area V2 that absorbs the flushing fluid ejected from the second nozzle row N2. As a result, one absorbing member 12 has the first absorbing area V1 that absorbs the flushing fluid ejected from the first nozzle row N1 in the forward movement path F1, and the second absorbing area V2 that absorbs the flushing fluid ejected from the second nozzle row N2 in the forward movement path F2, where the first and second absorbing areas V1 and V2 are alternately arranged. Then, the absorbing member 12 absorbing the fluid ejected from the first and second nozzle rows N1 and N2 which are adjacent to each other is wound on the winding rotation body 16.

As described above, since the absorbing member 12 absorbs the fluid ejected from the first and second nozzle rows N1 and N2 adjacent to each other in the forward movement path F1 and the backward movement path F2 by using different areas not overlapping with each other, it is possible to absorb the fluid without any gap (waste) using one absorbing member 12, and thus to efficiently use the absorbing member 12 for the flushing process. Accordingly, it is possible to reduce the running costs of the absorbing member 12, and to reduce the number of replacements.

Further, when the absorbing member is sent to the winding mechanism 13 by a distance (length) twice as long as the length of the nozzle row N1, the first absorbing area V1 facing the nozzle row N1 of the printing head 21E faces the nozzle row N1 of the printing head 21D in, for example, the forward movement path F1. Subsequently, when the absorbing member moves by a distance twice as long as the length of the nozzle row, the first absorbing area faces each of the printing heads 21A to 21E in the forward movement path F1, and receives the flushing fluid. Accordingly, the absorbing member 12 needs to have a thickness capable of absorbing the ink ejected during the flushing process. When it is difficult to absorb the fluid, the movement distance may be set to be 4 or 6 times longer than the length of the nozzle row. By increasing the movement distance in this way, it is possible to reduce the number receiving the flushing fluid, and thus to reduce the amount of absorbed ink.

Further, when the movement distance is set to be an even number times longer than the length of the nozzle row N1 (N2), the absorbing member 12 receives the flushing fluid using an area different from those of the forward movement path F1 and the backward movement path F2. In the embodiment, the absorbing member 12 can be used without any waste if the movement distance is 10 times. FIG. 12 is a diagram schematically illustrating FIG. 11, and is a diagram illustrating how many times the absorbing area V of the absorbing member 12 receives the fluid ejected from the heads 21A to 21E during the flushing process in accordance with the movement distance of the absorbing area V. Further, FIG. 12 shows that the absorbing areas V located at positions corresponding to the heads 21A to 21E receive the flushing fluid. Accordingly, the absorbing area V located at a position corresponding to a blank between the heads does not receive the flushing fluid. Further, in FIG. 12, the position marked as "reverse" is based on the fact that the distance in the path from the nozzle N11 located closest to the reversing rotation body 17 in the printing head 21A to the outermost end (a position farthest from the head) 17E of the reversing rotation body 17 is set to be equal to the length of the nozzle row N1 as described above.

As shown in FIG. 12, when the movement distance of the absorbing member is set to twice as long as the length of the nozzle row N1 (N2), the absorbing area V1 receiving the flushing fluid ejected from the heads 21E to 21A in the forward movement path F1 does not receive the flushing fluid in the backward movement path F2, but instead the absorbing area V2 not used for receiving the flushing fluid in the forward movement path F1 receives the flushing fluid in the backward movement path F2.

In addition, when the movement distance of the absorbing member is set to be 4 times longer than the length of the nozzle row, the absorbing area V1 receives the flushing fluid 3 times only in the forward movement path F1, the absorbing area V2 subsequent to the absorbing area V1 receives the flushing fluid 3 times only in the backward movement path F2, the absorbing area V3 subsequent to the absorbing area V2 receives the flushing fluid twice only in the forward movement path F1, and the absorbing area V4 subsequent to the absorbing area V3 receives the flushing fluid twice only in the backward movement path F2. That is, only the absorbing areas V1 and V3 receive the flushing fluid in the forward movement path F1, and only the absorbing areas V2 and V4 receive the flushing fluid in the backward movement path F2.

Further, when the movement distance of the absorbing member is set to be 10 times longer than the length of the nozzle row, only the absorbing areas V1, V3, V5, V7, and V9 receive the flushing fluid in the forward movement path F1, and only the absorbing areas V2, V4, V6, V8, and V10 receive the flushing fluid in the backward movement path F2.

Furthermore, when the movement distance of the absorbing member is set to be odd number times longer than the length of the nozzle row, the respective absorbing areas V of the absorbing member 12 receive the flushing fluid in the forward movement path F1 and the backward movement path F2. For example, as shown in FIG. 12, when the movement distance of the absorbing member is set to be 5 times longer than the length of the nozzle row, all the absorbing areas V1 to V5 receive the flushing fluid 1 time in the forward movement path F1 and the backward movement path F2.

Accordingly, when the absorbing member 12 moves along the nozzle row by an interval of the length of the nozzle row N1 (N2) within the range that is double the number of heads by which one absorbing member 12 passes, it is possible to use the absorbing member 12 without any waste.

Then, when most of the absorbing member 12 wound on the supply rotation body 15 of the winding mechanism 13 is wound on the winding rotation body 16 after the flushing process is performed plural times during the printing process, the absorbing member 12 is exchanged for a new replacement. At this time, in the embodiment, since both the supply rotation body 15 and the winding rotation body 16 are disposed at the same side, that is, one end side of the head unit 2 in the nozzle row direction P, it is possible to easily exchange the absorbing member 12 just by opening one side surface of the printer 1, and thus to improve maintenance efficiency.

As described above, according to the embodiment, since the linear absorbing member 12 is disposed between the printing sheet 8 and the printing head 21, and the linear absorbing member 12 moves to face the nozzle of the printing head 21 to absorb the ink ejected during the flushing process, it is possible to perform the flushing process without moving the head unit 2. Since the flushing process can be performed without moving the head unit 2, it is possible to perform the flushing process within a short time at an appropriate timing.

Then, one absorbing member 12 is turned back by the reversing rotation body 17 so as to overlap with both the first nozzle row N1 and the second nozzle row N2 adjacent to each other during the flushing process, and the fluid ejected from the first nozzle row N1 and the second nozzle row N2 is absorbed by different areas not overlapping with each other in the forward movement path F1 and the backward movement path F2, thereby absorbing the fluid using one absorbing member 12 without any gap (waste). Accordingly, it is possible to efficiently use the absorbing member 12 for the flushing process, to reduce the running costs of the absorbing member 12, and to reduce the number of replacements.

In addition, since the absorbing member 12 is a thin and linear member, the movement distance thereof is short, and the movement thereof is performed within a short time. For example, the absorbing member 12 may be disposed at a position corresponding to a gap between the nozzle rows during the printing process.

Further, since the absorbing member 12 is formed as a linear member, it is possible to suppress an upward air stream from occurring in the periphery of the absorbing member 12, and to prevent the ink from adhering to the heads 21A to 21E when the ink is dropped onto the absorbing member 12. For this reason, since it is possible to allow the absorbing member 12 to be close to the heads 21A to 21E, it is possible to suppress occurrence of mist that contaminates the heads 21A to 21E or the like and is generated by volatilization of the ink.

Furthermore, since the ejection target during the flushing process is the linear absorbing member 12, dot omission rarely occurs due to an influence of wind pressure generated when ejecting the ink to the absorbing member 12. In addition, since all the ink droplets ejected during the flushing process are absorbed by the absorbing member 12 in the vicinity of the nozzle 24, it is possible to prevent the printing sheet or the transportation belt portion 33 from being contaminated.

As described above, in the embodiment, since the flushing process can be simply performed at high speed, the printing performance is improved.

In addition, the movement mechanism 14 may have a position adjusting mechanism that adjusts a position of the absorbing member 12 in a direction perpendicular to the nozzle row L. Accordingly, it is possible to reliably move the absorbing member 12 to a position facing the nozzle row L, and to retreat the absorbing member 12 to a position not facing the nozzle row L.

Further, the plurality of absorbing members 12 may largely retreat to a position not facing the nozzle surfaces 23 of the printing heads 21 during the printing process. For example, the plurality of absorbing members 12 may retreat to a position on the side surface of the printing head 21 or a position below the printing sheet (medium). In addition, when the absorbing members 12 retreat in this way even when performing the capping process using the cap unit, it is possible to satisfactorily cap the nozzle surfaces 23 of the printing heads 21 using the cap portion 61.

Furthermore, when a tape-like member (cloth or the like) having a narrow width is used as the absorbing member, it is possible to satisfactorily seal the nozzle surface 23 even while the absorbing member is interposed between the printing head 21 and the cap portion 61.

Second Embodiment

The basic configuration of the ink jet printer of the second embodiment to be shown below is substantially the same as that of the first embodiment, but the configuration of the flushing unit is different. Accordingly, in the description below, the differences from the above-described embodiment will be described, and the similarities will not be described. Further, in the respective drawings used for the description, the same reference numerals will be given to the same components as those of FIGS. 1 to 12.

Figure 13:
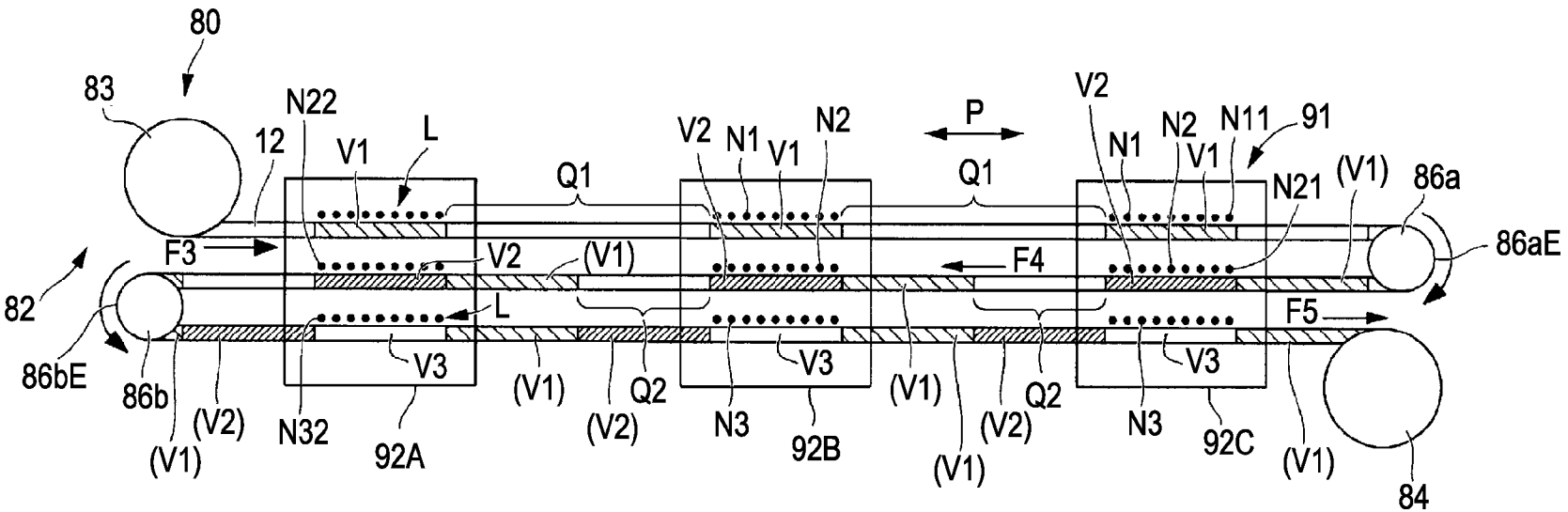
FIG. 13 is a plan view illustrating a configuration of a main part of a printer of a second embodiment.

FIG. 13 is a schematic diagram illustrating the flushing unit of the printer of the second embodiment.

Further, in FIG. 13, the absorbing members are located at positions overlapping with the nozzle rows during the flushing process, but are intentionally depicted to deviate therefrom for the description of the ejecting (absorbing) position.

A flushing unit 80 of the embodiment has a structure in which a supply rotation body (supply portion) 83 constituting a winding mechanism (a second movement mechanism) 82 for moving the absorbing member 12 is disposed at one end side in the nozzle row direction P of a head unit 91 constituted by three printing heads 92A to 92C, and a winding rotation body (winding portion) 84 is disposed at the other end side of the head unit 91. Then, reversing rotation bodies (reversing portions) 86*a* and 86*b* are respectively disposed at both one end and the other end of the head unit 91 in the nozzle row direction P. Then, the absorbing member 12 is supplied from the supply rotation body 83 on one end side of the head unit 91, and is turned back by the reversing rotation body 86*a* on the other end side thereof. Subsequently, the absorbing member 12 is turned back again by the reversing rotation body 86*a* on one end side thereof, and reaches the winding rotation body 84 on the other end side thereof. That is, one absorbing member 12 is disposed so as to overlap with the first nozzle row N1 of the head unit 91, the second nozzle row N2 adjacent thereto, and the third nozzle row N3 in the vicinity thereof during the flushing process.

Here, a distance between the nozzle rows L (N1 to N3) of three printing heads 92A to 92C of FIG. 13 is set to be twice as long as the distance of each of the nozzle rows L (N1 to N3). That is, in the embodiment, three pairs of head modules (not shown) are disposed so that the heads deviate from each other and adjacent to each other between different modules.

Then, as shown in FIG. 13, a distance in the path from the nozzle N11 (strictly speaking, a position close to the reversing rotation body 86*a* by a half of the pitch between the nozzles) located closest to the reversing rotation body 86*a* in the printing head 92C to the outermost end (a position farthest from the head) 86*a*E of the reversing rotation body 86*a* is set to be 1.5 times longer than the length of the nozzle rows L (N1 to N3). That is, a distance in the path from the nozzle N11 (strictly speaking, a position close to the reversing rotation body 86*a* by a half of the pitch between the nozzles) located closest to the reversing rotation body 86*a* in the printing head 92C to the nozzle N21 (strictly speaking, a position close to the reversing rotation body 86*a* by a half of the pitch between the nozzles) located closest to the reversing rotation body 86*a* of the next nozzle row L (N2) while passing (being reversed) by the reversing rotation body 86*a* is set to be 3 times longer than the length of the nozzle rows L (N1 to N3). Likewise, a distance in the path from the nozzle N22 (strictly speaking, a position close to the reversing rotation body 86*b* by a half of the pitch between the nozzles) located closest to the reversing rotation body 86*b* in the printing head 92A to the outermost end 86*b*E of the reversing rotation body 86*b* is set to be 1.5 times longer than the length of the nozzle rows L (N1 to N3). Accordingly, a distance in the path from the nozzle N22 (strictly speaking, a position close to the reversing rotation body 86*b* by a half of the pitch between the nozzles) located closest to the reversing rotation body 86*b* in the printing head 92A to the nozzle N32 (strictly speaking, a position close to the reversing rotation body 86*b* by a half of the pitch between the nozzles) located closest to the reversing rotation body 86*b* of the next nozzle row L (N3) while passing (being reversed) by the reversing rotation body 86*b* is set to be 3 times longer than the length of the nozzle rows L (N1 to N3). Then, the movement amount of the absorbing member 12 moved by the winding mechanism 82 is set to be 3 times longer than the length of the nozzle rows L (N1 to N3).

The flushing unit 80 with such a configuration drives a movement mechanism (not shown) during the flushing process, and moves the absorbing member 12 so as to overlap with the ink ejecting direction of the nozzle row L of the head unit 91. Subsequently, the control device performs the flushing process on the head unit 91, and ejects ink from each of the nozzle rows L of the printing heads 92A to 92C toward the opposite absorbing member 12 (for example, about 10 droplets). The ink droplets ejected from the nozzle row L are absorbed by the absorbing member 12.

When the flushing process ends, the control device drives the movement mechanism so as to move the plurality of absorbing member 12 to the retreat position as in the first embodiment.

Subsequently, the control device drives the winding mechanism 82 so as to move the absorbing member 12. Although the flushing process on the absorbing member 12 is performed between the printing sheets, the movement of the absorbing member 12 using the movement mechanism or the winding mechanism 82 is performed during a time when the printing process is performed on the printing sheet as in the first embodiment.

As shown in FIG. 13, the absorbing member 12 supplied from the supply rotation body 83 of the winding mechanism 82 are located at a position overlapping with, for example, the first nozzle row N1 among the nozzle rows L of the printing heads 92A to 92C in the first forward movement path F3 facing from one end side of the head unit 91 toward the other end side thereof in the nozzle row direction P. Then, the absorbing member absorbs the flushing fluid ejected from the first nozzle row N1 in the first forward movement path F3. Accordingly, the absorbing member 12 has the first absorbing area V1 that absorbs the flushing fluid ejected from the first nozzle row N1. The length of the first absorbing area V1 is substantially set to be equal to the length of the first nozzle row N1. Further, a first non-absorbing area Q1 not absorbing the fluid is formed between the first absorbing areas V1. Since the width (length) of the first non-absorbing area Q1 is twice as long as a gap between the adjacent nozzle rows L of the printing heads 92A to 92C, the width is twice as long as the length of the nozzle row N1.

In this way, the absorbing member 12 absorbing the flushing fluid ejected from the first nozzle row N1 while ensuring the first non-absorbing areas Q1 at a predetermined interval in the first forward movement path F3 is turned back by the reversing rotation body (reversing portion) 86*a*. Then, the absorbing member moves along a position overlapping with the second nozzle row N2 adjacent to the first nozzle row N1 among the nozzle rows L of the printing heads 92A to 92C in the backward movement path F4 facing from the other end side of the head unit 91 toward one end side thereof in the nozzle row direction P.

Then, in the absorbing member 12 turned back by the reversing rotation body 86*a*, the flushing fluid is ejected from the second nozzle row N2 of each of the printing heads 92A to 92C to a half area on the rear side of the first non-absorbing area Q1, that is, the third absorbing area V3 in the backward movement path F4. Accordingly, the absorbing member 12 has the second absorbing area V2 that absorbs the flushing fluid ejected from the second nozzle row N2. As described above, the second absorbing area V2 is a half of the length on the rear side of the first non-absorbing area Q1, and the remaining portion thereof is the second non-absorbing area Q2.

In this way, the absorbing member 12 absorbing the flushing fluid ejected from the first and second nozzle rows N1 and N2 while ensuring the second non-absorbing areas Q2 at a predetermined interval in the first forward movement path F3 and the backward movement path F4 is turned back again by the reversing rotation body (reversing portion) 86*b*. Then, the absorbing member moves along a position overlapping with the third nozzle row N3 adjacent to the second nozzle row N2 among the nozzle rows L of the printing heads 92A to 92C in the second forward movement path F5 facing from one end side of the head unit 91 toward the other end side thereof in the nozzle row direction P.

Then, the flushing fluid is ejected from the third nozzle row N3 of each of the printing heads 92A to 92C to the second non-absorbing area Q2 in the second forward movement path F5. Accordingly, the absorbing member 12 has the third absorbing area V3 that absorbs the flushing fluid ejected from the third nozzle row N3. As a result, the absorbing member 12 has the first absorbing area V1, the second absorbing area V2, and the third absorbing area V3 that respectively absorb the flushing fluid ejected from the first to third nozzle rows N1 to N3. Then, the absorbing member 12 is wound on the winding rotation body 84.

Even in the second embodiment, since different areas of the absorbing member 12 not overlapping with each other absorb the fluid ejected from the first nozzle row N1, the second nozzle row N2, and the third nozzle row N3 sequentially adjacent to each other in the first forward movement path F3, the backward movement path F4, and the second forward movement path F5, it is possible to absorb the fluid using one absorbing member 12 without any gap (waste), and to efficiently use the absorbing member 12 for the flushing process. Accordingly, it is possible to reduce the running costs of the absorbing member 12, and to reduce the number of replacements.

Further, even in the embodiment, when the movement amount of the absorbing member 12 moved by the winding mechanism 82 is set to be, for example, 3 to 6 times longer than the length of the nozzle rows L (N1 to N3) within a range twice more than the number of heads by which one absorbing member 12 passes, it is possible to use the absorbing member 12 without any waste.

Figure 14:
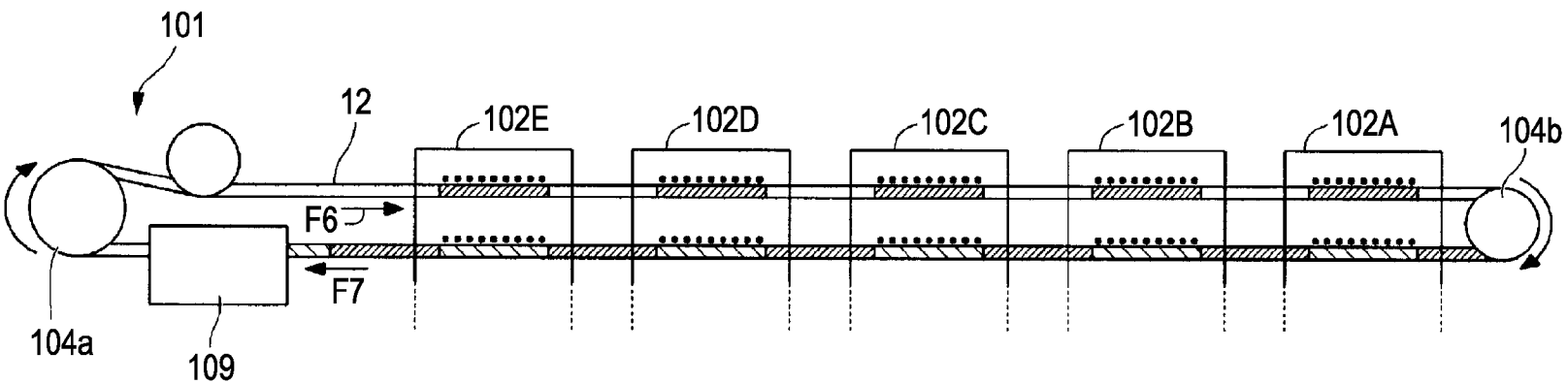
FIG. 14 is a plan view illustrating a configuration of a main part of a printer of another embodiment.

As another embodiment, for example, as shown in FIG. 14, it is desirable to provide a cleaning mechanism for cleaning the absorbing member.

According to a flushing unit 101 shown in FIG. 14, reversing rotation bodies (reversing portions) 104*a* and 104*b* are respectively formed at one end and the other end of a head unit 103 in the nozzle row direction P of the printing heads 102A to 102E. Then, the absorbing member 12 is suspended between the reversing rotation bodies 104*a* and 104*b* in an annular shape (endless shape).

In this flushing unit 101, the absorbing member 12 absorbs the flushing fluid ejected from the first nozzle row N1 in the forward movement path F6, absorbs the flushing fluid ejected from the second nozzle row N2 in the backward movement path F7, and then the absorbing member 12 containing the fluid (ink) is cleaned by a cleaning mechanism 109. Then, the absorbing member 12 is supplied again so as to absorb the fluid (ink).

According to the embodiment, since it is possible to recycle the absorbing member 12 by cleaning the absorbing member 12 absorbing the fluid (ink), it is possible to continuously use the absorbing member 12. Accordingly, it is not necessary to exchange the absorbing member 12. Further, it is possible to reduce trouble in the exchange operation, and to reduce the costs of the absorbing member 12.

While the preferred embodiments of the invention are described as above with reference to the accompanying drawings, it is needless to say that the invention is not limited to the preferred embodiments, and the preferred embodiments may be combined with each other. It is apparent that various modifications and corrections can be made by persons skilled in the art within the scope of the technical spirit according to the claims, and it should be, of course, understood that the modifications and corrections are included in the technical scope of the invention.

For example, in the first embodiment, the plurality of absorbing members 12 are adapted to be wound simultaneously, but may be adapted to be wound individually. Further, in the above-described embodiments, the absorbing members 12 are disposed to be parallel to the nozzle rows. However, the invention is not limited thereto, and the extension direction of the absorbing members 12 may not be perfectly parallel to the extension direction of the nozzle rows. That is, in the invention, that the absorbing members extend along the nozzle rows means not only a state where the absorbing members are perfectly parallel to the nozzle rows, but also a state where the absorbing members 12 are disposed in a range capable of receiving the fluid during the flushing process. In addition, the absorbing members may be inclined with respect to the nozzle rows during the retreat operation thereof. For this reason, the movement amounts of the movement members 14A and 14B may be different from each other.

Further, in the above-described embodiments, a configuration has been described in which the invention is applied to the line head type printer. However, the invention is not limited thereto, but may be applied to a serial type printer.

Furthermore, in the above-described embodiments, a configuration has been described in which the absorbing members 12 normally move between the head and the printing sheet (medium). However, the invention is not limited thereto, but a configuration may be adopted in which the absorbing members 12 move to an area deviating from a position directly below the head (for example, the side portion of the head) during the retreat operation thereof.

Moreover, in the above-described embodiments, a configuration has been described in which the absorbing members 12 are located between the head and the transportation area of the printing sheet during the maintenance process. However, the invention is not limited thereto, but a configuration may be adopted in which the absorbing members 12 move to a position below the transportation area of the printing sheet during the maintenance process.

In the above-described embodiments, an ink jet printer is adopted, but a fluid ejecting apparatus for ejecting a fluid other than ink or a fluid container for storing the fluid may be adopted. Various fluid ejecting apparatuses including a fluid ejecting head for ejecting a minute amount of liquid droplet may be adopted. In addition, the liquid droplet indicates the fluid ejected from the fluid ejecting apparatus, and includes a liquid having a particle shape, a tear shape, or a linear shape. Further, here, the fluid may be a material which can be ejected from the liquid ejecting apparatus.

For example, a liquid-state material may be used, including a liquid-state material such as sol or gel water having a high or low viscosity, a fluid-state material such as an inorganic solvent, an organic solvent, a liquid, a liquid-state resin, or liquid-state metal (metallic melt), and a material in which a functional material having a solid material such as pigment or metal particle is dissolved, dispersed, or mixed with a solvent in addition to a fluid. In addition, ink or liquid crystal described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used.

In addition, a fluid ejecting apparatus for ejecting lubricant from a pinpoint to a precise machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of the fluid ejecting apparatuses and a fluid container thereof.

What is claimed is:

1. A fluid ejecting apparatus comprising:

a fluid ejecting head which includes nozzle rows having a first nozzle row and a second nozzle row adjacent the first nozzle row in a direction intersecting an extension direction of the first nozzle row, the fluid ejecting head ejecting fluid from the nozzle rows;

an absorbing member which is supplied in the extension direction of the first nozzle row from one end side toward another end side of the first nozzle row, a portion of the absorbing member facing the first nozzle row, the absorbing member being reversed at the another end side and the portion of the absorbing member being supplied to face the second nozzle row, and the absorbing member absorbing the fluid ejected from the nozzle rows;

a first movement mechanism which moves the absorbing member in a direction intersecting the extension direction of the nozzle row; and a second movement mechanism which moves the absorbing member in the extension direction of the nozzle row, the second movement mechanism includes a supply portion which supplies the absorbing member, a reversing portion which is formed at a position turning back the absorbing member, and a winding portion which winds the absorbing member.

2. The fluid ejecting apparatus according to claim 1, wherein the supply portion is formed as a supply rotation body which supplies the absorbing member, wherein the winding portion is formed as a winding rotation body which winds the absorbing member, and wherein all the supply rotation body and the winding rotation body are formed at one end side of the extension direction.

3. The fluid ejecting apparatus according to claim 1, further comprising: a cleaning mechanism that cleans the absorbing member.

4. The fluid ejecting apparatus according to claim 1, wherein the absorbing member absorbs the fluid ejected from the first nozzle row while ensuring non-absorbing areas at a predetermined interval in a forward movement path where the absorbing member moves from one end side of the extension direction toward the other end side thereof, and wherein the non-absorbing areas absorb the fluid ejected from the second nozzle row adjacent to the first nozzle row in an intersection direction in a backward movement path where the absorbing member moves from the other end side of the extension direction toward the one end side thereof via the reversing portion.

5. The fluid ejecting apparatus according to claim 1, wherein the first movement mechanism spaces the absorbing member apart from a nozzle surface of the fluid ejecting head during the absorbing process, the nozzle surface being provided with the nozzle rows.

* * * * *